United States Patent [19]

de la Chauvinière, neé Chantal et al.

[11] 3,955,297

[45] May 11, 1976

[54] DEVICE FOR ANIMATING AN IMAGE

[76] Inventors: Riant de la Chauvinière, neé Chantal, 167 bis, Ave. V. Hugo; François de la Chauvinière, 88, Ave. Henri Martin, both of 75116 Paris, France

[22] Filed: Feb. 19, 1974

[21] Appl. No.: 443,841

[30] Foreign Application Priority Data

Feb. 22, 1973 France ..... 73.06237

[52] U.S. Cl. ..... 40/106.53; 40/106.54

[51] Int. Cl.[2] ..... G09F 11/21

[58] Field of Search..... 40/106.53, 106.52, 106.54, 40/106.51, 36, 30, 35, 137

[56] References Cited

UNITED STATES PATENTS

| | | | |
|---|---|---|---|
| 1,139,222 | 5/1915 | Poulalion | 40/132 |
| 1,387,631 | 8/1921 | Tibbles | 40/106.53 X |
| 2,085,803 | 7/1937 | Harrison | 40/106.51 |
| 2,265,355 | 12/1941 | David | 40/106.53 |
| 2,937,564 | 5/1960 | Halford | 40/106.52 X |
| 3,277,597 | 10/1966 | Trame | 40/106.53 |
| 3,314,180 | 4/1967 | Porter | 40/135 X |
| 3,345,767 | 10/1967 | Lusebrink | 40/106.53 |
| 3,629,965 | 12/1971 | Heindl | 40/63 A |

*Primary Examiner*—Louis G. Mancene
*Assistant Examiner*—John F. Pitrelli
*Attorney, Agent, or Firm*—Haseltine, Lake & Waters

[57] ABSTRACT

Animation of an image is effected by providing transparent and opaque figures on sheets arranged one behind the other in spaced relation and by modifying the spacing at intervals in the range of 0.1 to 10 seconds and preferably in the range of 0.5 to 10 seconds.

4 Claims, 8 Drawing Figures

DEVICE FOR ANIMATING AN IMAGE

BACKGROUND OF THE INVENTION

1. Field of the invention

This invention relates to an animation device, such as an animated picture, a publicity display means or advertisement panels showing an image obtained by the arrangement in successive planes of sheets comprising transparent and opaque elements adapted to be disposed one behind the other, in which device there is provided a means of at least partial modification of the relative spacing of the sheets in relation to one another.

2. Description of the prior art

In the field of publicity it is often desired to draw the attention of customers by images which appear to be in relief and which are animated. Very many lighting processes have been used for this purpose. Most of these processes and the device which put them into practice nevertheless require complicated and expensive technical means, necessitating permanent electrical or mechanical installations, or at least expensive and bulky equipment which is difficult to maintain and the installation of which takes a long time. Illuminated panels composed of a large number of electric bulbs, cinematographic projection, and automatons may be mentioned as known technical publicity means permitting animation.

American Pat. No. 3,314,180 discloses a device recreating an image in relief which is composed of various superimposed transparent supports, each of which carries a portion of the image which is to be recreated. In this patent the transparent supports are vibrated at a frequency at least equal to 15 Hz in order to obtain a three-dimensional image "so that the pictured objects seem solid from front to back". The means proposed by this American patent comprise resilient fastening of the edges of the supports and a vibration period at most equal to the persistance time of the image on the retina, because it is required to obtain an illusion of an image which has volume but appears to be fixed. A certain blurring of the image necessarily results from the vibrations.

SUMMARY

The present invention provides an animation device which completely departs from the prior art in respect of its means and its results, and which does not hesitate to show the images in successive planes.

It is an object of the invention to provide animation devices which utilise only economical means, which are easily installed in position, and which make it possible to develop a publicity theme by producing images giving the impression of movement, thus creating an illusion of animation of an image in three dimensions which is clear and free from blurring.

Another object of the invention is to provide devices suitable for numerous fields of presentation, comprising for example not only show window displays but also advertisement panels, or animated pictures.

A further object of the invention is to present an animated image which can be accompanied by a change of scene with a certain impression of calm which is favourable to the attraction of the customer.

According to the invention these aims are achieved in a device of the kind first described above through the fact that the sheets are disposed so as to be movable and free in respect of clearance in relation to one another, and that the means of modifying the relative spacing of the sheets in relation to one another acts at intervals of time at least equal to 0.1 second (10 Hz), preferably between 0.5 and 10 seconds (120 to 6 times per minute).

The fact that the sheets are so disposed as to be movable and free in respect of clearance fundamentally distinguishes the invention from the previous known arrangement in which the resilient elements maintain a practically constant distance at the edge of the sheets, thus practically permitting variation of spacing only by vibration in the centre of the sheets.

The invention on the other hand permits free variation of spacing of the sheets, thus permitting substantial variations of lighting, shade, and even of scene by changing the lighting of the planes, without the ambient lighting being modified.

In the invention the eye of an observer perceives at every moment an image which is clear although moving, because it is essential that the modifications of arrangements should be relatively slow so that the eye can follow the movements.

It is advantageous that the sheets of transparent or opaque materials (in which latter case they may be cut out) should carry traced, drawn, or applied elements, such as drawings, lines, flat colourings, stencilling, etc., and that they should be joined together in accordion fashion.

It is also advantageous that the device should be mounted in a frame containing, face to face, a front and a back which are both fixed and each of which may optionally be composed of a sheet containing elements contributing towards the formation of the image.

In one embodiment the movable sheets, which are optionally connected in accordion fashion, are suspended in the frame between the front and the back and a mechanism positively moves at least two of these sheets towards and/or away from one another.

It is very advantageous that the frame should contain at least one fixed lighting source disposed laterally, and also that the sheets, when they are joined in accordion fashion, should be disposed with the joints vertical.

In a variant the means of modifying the relative spacing of the sheets in relation to one another is composed of an air blower.

The means according to the invention have the effect that the arrangement of the shadows cast by the opaque elements on one another and even on the transparent coloured elements depends on the instantaneous relative arrangement of the sheets. If the sheets are in a fixed position in relation to one another, the lighting will produce shadows which give an impression of relief. If the relative arrangements of the sheet are varied by the device according to the invention, this results in concomitant modification of the distribution of the shadows on the different sheets, that is to say on the different planes of the image. This then results in a very surprising illusion of animation of the image. The effect of relief through distribution of shadows and through the changing of planes in the lighting by the means described, on the one hand, and the illusion of animation which results from the variations of shadow, on the other hand, are essential to the invention, and the shadow and the change of lighting then constitute, through their effect and through the change of scene which results therefrom, an intangible means the use of which according to the invention contributes towards the results obtained.

DESCRIPTION OF PREFERRED EMBODIMENTS

Figure 1:
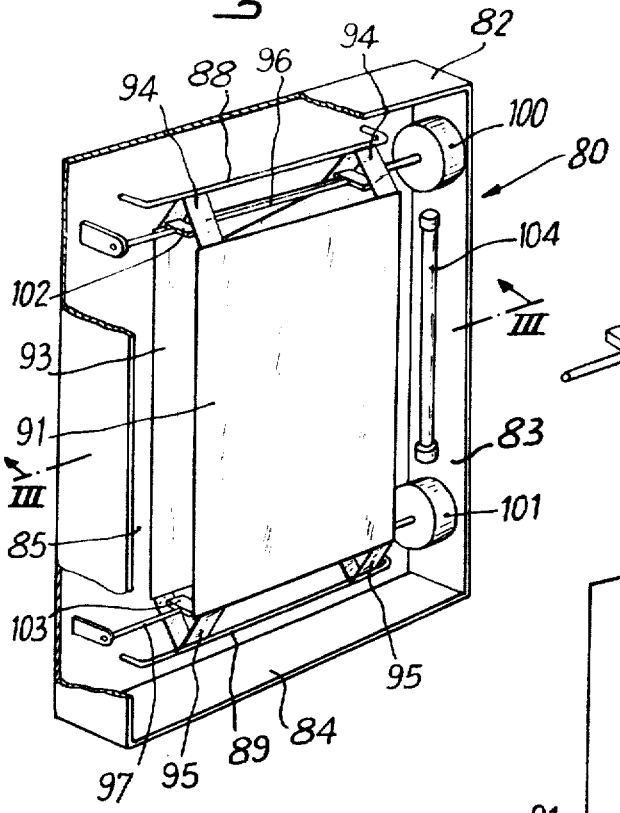
FIG. 1 shows diagrammatically a preferred form of construction of a device according to the invention, shown in perspective after removal of the front face and part of its frame.
Figure 2:
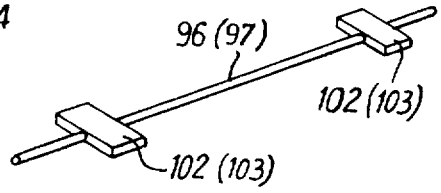
FIG. 2 is a detail view of part of the device shown in FIG. 1.
Figure 3:
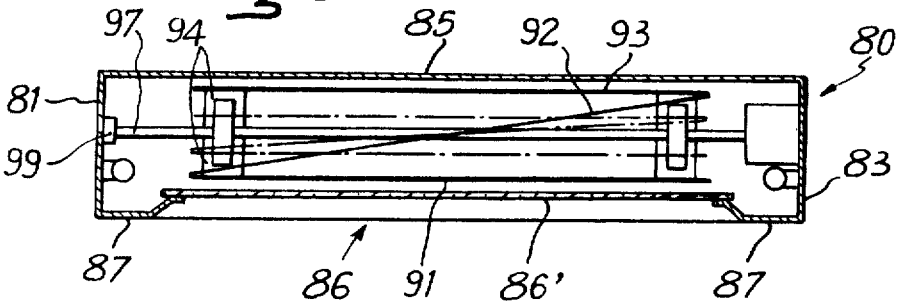
FIG. 3 is a view in horizontal section on the line III—III, FIG. 1.

In FIGS. 1, 2, and 3 there is shown a preferred form of a device according to the invention which may serve as an animated picture, a publicity display means, or an advertising panel. A frame 80 has four sides 81, 82, 83, 84, an opaque back 85, and a face 86, FIG. 3, formed by a projecting portion 87 of the frame. The face 86 comprises a fixed sheet 86' of glass or transparent synthetic material.

Two horizontal rods 88, 89 are fixed to the frame, respectively in the top and bottom portions. The two rods respectively carry pairs of blades 94, 95 which fasten sheets 91, 93 which can be disposed in the frame one behind the other between the front and the back. The sheets 91, 93 are fixed on the pairs of blades 94, 95 by any means known per se, such as by adhesion or by gripping in a slit in the blades. The blades 94, 95 are mounted for articulation and face one another in a V-arrangement on the rods 88, 89, and are normally held close together by any resilient means known per se, such as a rubber part or a spring, tending to close the V.

Two shafts 96, 97 respectively pass through the space between the sides of the V's, each being carried at one end in a fixed bearing (not shown), and at the other end in the slow output shaft connection of an electric micromotor 100, 101. The shafts 96, 97 each respectively carry two palette-shaped cams 102, 103 each of which is slipped between the two sides of a V of the blades 94, 95. The cam may for example, be made of sheet metal of a thickness of 1 mm and with a dimension of from 12 to 50 mm in the direction in which they move the V's apart, so that the sheets 91, 93 can be moved together or moved apart by from 12 to 50 mm.

If the micromotors 100, 101 are operated with an output shaft speed of a frequency lower than the relaxation frequency of the resilient system formed by the sheets, the V's, and their springs, synchronous modifications of the relative spacing of the sheets in relation to one another will be obtained. It is important that an observer sees at every moment a clear image and that the impression of animation results not from an effect of moving but from a variation of the zones of light and shade of the elements of the sheets on one another. It is for this reason that there is no disadvantage in having a set of sheets and return springs having a predetermined relaxation time. A speed of rotation of the shafts of the micromotors of from 3 to 60 revolutions per minute, corresponding to from 6 to 120 movements towards and away from one another per minute, that is 0.5 to 10 movements per second, is in conformity with the invention.

Very attractive results have been obtained at speeds of from 8 to 15 movements per minute, that is at least 0.1 per second, of the sheets away from one another, representing for example the breathing of a person.

Figure 4:
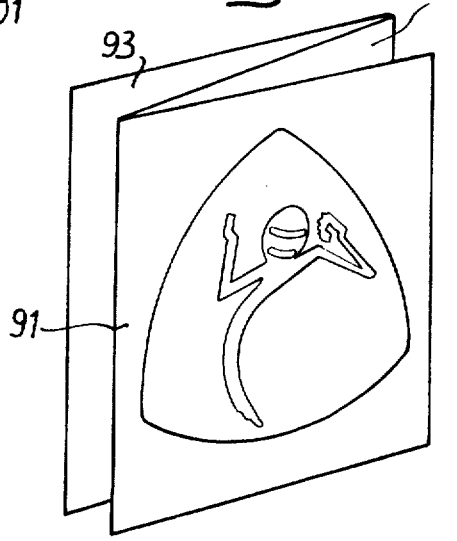
FIG. 4 shows a set of sheets intended to produce an animated image in the device shown in FIGS. 1 and 3.

The image is to be obtained through the arrangement in successive planes of sheets comprising transparent elements and opaque elements. The set of sheets to be introduced for this purpose in the display unit is joined together in accordion fashion, for example, as illustrated in FIG. 4, and is thus ready for introduction into the apparatus shown in FIGS. 1, 2, and 3. Each of these sheets comprises transparent, coloured or uncoloured, or cut-out elements and opaque elements distributed so as to obtain a representational or non-representational overall aesthetic effect.

Figure 5:
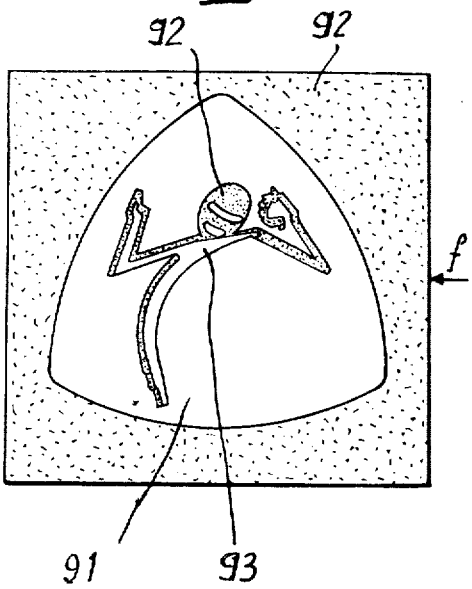
FIG. 5 shows in the flat state the set of sheets shown in FIG. 4.

FIG. 5 shows the three sheets 91, 92, 93, which are assumed to be pressed correspondingly against one another.

Any drawings provided on the fixed sheet 86' and on the back 85 may contribute, together with the sheets 91, 92, 93, towards forming the desired image or decor.

The frame is, in addition, provided on its side uprights 81 and 83 with two electric lamps 104 illuminating laterally the sheet 91 or the sheet 92, depending on their position, so that in combination with the variations of spacing of the sheets there are obtained variations of colour, lighting, and shade cast by the elements on one another, thus giving the image an appearance of a changing decor.

In order to increase the strength of the construction the two shafts 96, 97 are driven by two micromotors, but it would be possible to use a single micromotor driving only the top shaft, or to drive the bottom shaft by a chain and pinion drive.

In the preferred embodiment of the invention there has been described a particular arrangement of a suspension and positive driving mechanism for at least two sheets. Another mechanism exactly fulfilling the same functions would be similarly convenient, for example one in which the sheets are suspended on short upper slides perpendicular to the front and to the back of the frame, an eccentric drive being used to move the sheets apart and towards one another.

Figure 6:
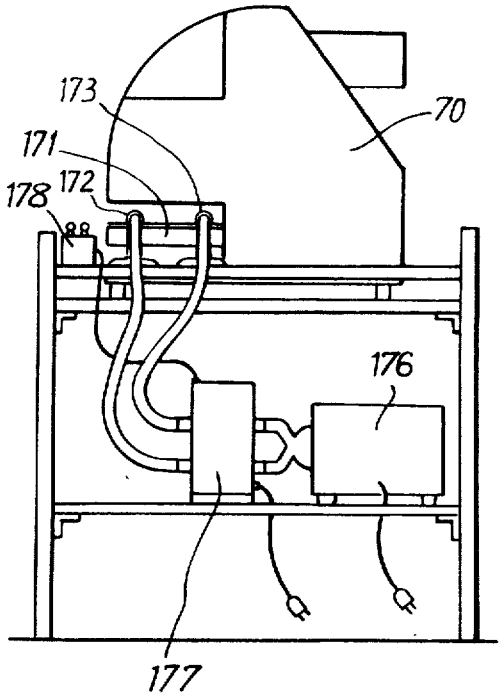
FIG. 6 is a diagrammatic side view of another form of device according to the invention.
Figure 8:
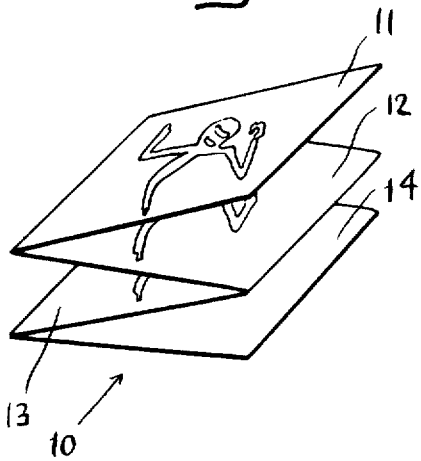
FIG. 8 shows a set of sheets intended to produce an animated image in the device shown in FIG. 6.
Figure 7:
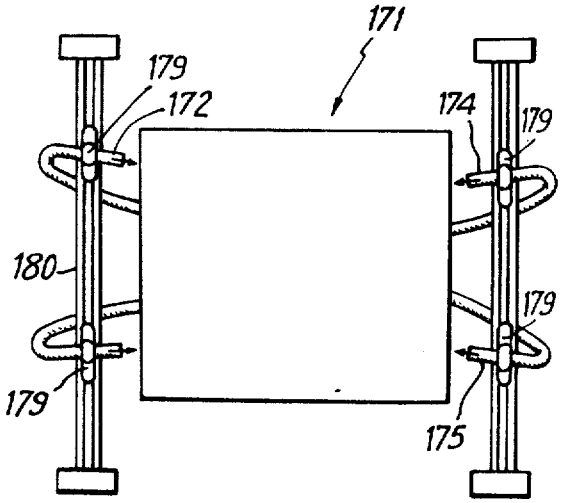
FIG. 7 is a plan view of a detail of FIG. 6.

Another embodiment of the invention is illustrated in FIGS. 6 and 7. This form of construction is suitable for optical projection, by means of a back projector of a kind known per se, of an image obtained by modifying the relative spacing of four sheets 11, 12, 13, 14 of an accordion-folded document 10, the sheets of which carry opaque and transparent elements, as illustrated in FIG. 8.

A back projector 70 of a kind known per se, and therefore containing a powerful means of lighting its worktable, is provided on this worktable with a blower plate 171 the sides of which receive the ends of four pipes 172, 173, 174, 175 fastened at 179 on adjusting slides 180 carried by the plate 171 and connected to an air blower 176 through a set of valves contained in a casing 177. The valves can be controlled by an electronic programmer 178 of a kind known per se, distributing the blown air sometimes from the right-hand side of the table, sometimes from the left-hand side, and sometimes from both sides simultaneously.

If the document 10 is disposed on the blower plate 171 in such a manner that the air blows sometimes from the right and sometimes from the left in the direction of the sheets, substantially parallel to the sheets and perpendicularly to the folds, this results in a modification of from 1 to 2 cm of the total relative spacing of the illuminated sheets, thus providing through projection an attractive effect of animation.

With regard to the frequency of the changes of air blowing, the limits according to the invention will be respected, that is to say they will preferably be of the order of from 0.5 to 10 seconds, or if need be from 0.5 to 0.1 second, without ever using a higher frequency. Animation by a blowing device according to the invention may be applied to all kinds of devices suitable for performing the invention, particularly devices for vertical images which, as described in connection with the first embodiment, are carried by frames or panels or suspended by any known means, such as pivots, hooks, rings, or slides.

It is emphasised that the descriptions given above are of examples only of embodiments of the invention, and that these descriptions can give only a slight idea of the actually surprising effect produced by devices according to the invention.

We claim:

1. An image animation device which comprises a frame containing a front and a back which are fixed, said front being at least partially transparent, means in said frame for disposing at least three sheets, one behind the other in spaced relation, said sheets including transparent elements and opaque elements, the sheets being joined together in accordion fashion, disposed one behind the other, with vertical joints and movable to permit transverse modification of the spacing therebetween, means in said frame operable at intervals of time in the range of 0.1 seconds to 10 seconds to modify transversally the relative spacing of at least two sheets in relation one to another by movement of said sheets conjointly in accordion fashion with front and rear displacement of the vertical joints, and at least one fixed luminous source arranged laterally of said sheets and operable to illuminate frontwardly at least one of said three sheets.

2. An image animation device as claimed in claim 1 wherein said back is opaque.

3. An image animation device as claimed in claim 1 in which said intervals are in the range of 0.5 to 10 seconds.

4. An image animation device according to claim 1 comprising means for returning the sheets to a position of equilibrium.

* * * * *

UNITED STATES PATENT AND TRADEMARK OFFICE

CERTIFICATE OF CORRECTION

PATENT NO. : 3,955,297
DATED : May 11, 1976
INVENTOR(S) : Riant et al.

It is certified that error appears in the above-identified patent and that said Letters Patent are hereby corrected as shown below:

Correct the name of first Applicant to:

RIANT nee Chantal de la CHAUVINIERE

Signed and Sealed this

Fourth Day of January 1977

[SEAL]

*Attest:*

RUTH C. MASON
*Attesting Officer*

C. MARSHALL DANN
*Commissioner of Patents and Trademarks*